United States Patent [19]

Seiter et al.

[11] Patent Number: 4,707,290

[45] Date of Patent: Nov. 17, 1987

[54] GRANULAR ADSORBENT

[75] Inventors: Wolfgang Seiter, Neuss; Otto Koch, Leichlingen, both of Fed. Rep. of Germany

[73] Assignee: Henkel Kommanditgesellschaft auf Aktien, Duesseldorf, Fed. Rep. of Germany

[21] Appl. No.: 807,065

[22] Filed: Dec. 9, 1985

[30] Foreign Application Priority Data

Dec. 10, 1984 [DE] Fed. Rep. of Germany ..... 3444960

[51] Int. Cl.[4] ..... C11D 17/06

[52] U.S. Cl. ..... 252/140; 252/91; 252/174.13; 252/174.24; 252/174.25; 252/135

[58] Field of Search ..... 252/140, 91, 174.13, 252/174.24, 174.25, 135

[56] References Cited

U.S. PATENT DOCUMENTS

| | | | |
|---|---|---|---|
| 3,849,327 | 11/1974 | DiSalvo et al. | 252/109 |
| 3,886,098 | 5/1975 | DiSalvo et al. | 252/540 |
| 4,148,603 | 4/1979 | Schwuger et al. | 8/137 |
| 4,260,651 | 4/1981 | Wixon | 252/174.25 |
| 4,269,722 | 5/1981 | Joshi et al. | 252/90 |
| 4,347,152 | 8/1982 | Wixon | 252/174 |
| 4,406,808 | 9/1983 | Gangwisch et al. | 252/174.25 |
| 4,552,681 | 11/1985 | Koch et al. | 252/174.21 |

FOREIGN PATENT DOCUMENTS

| | | |
|---|---|---|
| 1062984 | 9/1979 | Canada . |
| 21267 | 1/1981 | European Pat. Off. . |
| 0124913 | 11/1984 | European Pat. Off. . |
| 2531961 | 2/1976 | Fed. Rep. of Germany . |
| 2652488 | 5/1978 | Fed. Rep. of Germany . |
| 3316513 | 11/1984 | Fed. Rep. of Germany . |
| 2095274 | 9/1982 | United Kingdom . |

OTHER PUBLICATIONS

Chemical Abstract 84:137647v, 102:64007q, 89:26436j.

*Primary Examiner*—Paul Lieberman
*Assistant Examiner*—Hoa Van Le
*Attorney, Agent, or Firm*—Ernest G. Szoke; Henry E. Millson, Jr.; Real J. Grandmaison

[57] ABSTRACT

The present invention relates to a granular adsorbent having a high uptake capacity for liquid ingredients of detergents and cleaning preparations, comprising (a) 60 to 80 wt. % of a cation-exchanging, synthetic aluminosilicate selected from the group consisting of zeolite A, zeolite X and mixtures thereof, said aluminosilicate containing water of hydration;

(b) 0.05 to 5 wt. % of sodium silicate having a $Na_2O$ to $SiO_2$ mol ratio within the range of about 1:2 to about 1:3.5;

(c) 3 to 15 wt. % of a homopolymer of a monomer selected from the group consisting of acrylic acid, methacrylic acid and maleic acid; or a copolymer made by polymerizing a mixture containing at least one of said monomers, and (d) 8 to 18 wt. % of water removable at a temperature of about 145° C.

The adsorbent may optionally include up to 5 wt. % of a nonionic surfactant. The adsorbent has an average particle size within the range of about 0.2 to 1.2 mm, and a bulk density in the range of about 400 to 700 g/l.

17 Claims, No Drawings

GRANULAR ADSORBENT

BACKGROUND OF THE INVENTION

1. Field of the Invention

This invention relates to a granular adsorbent having a high uptake capacity for liquid ingredients of detergents and cleaning preparations, and in particular for liquid nonionic surfactants. The granular adsorbent of the present invention is particularly suitable for use in low-phosphate or phosphate-free detergents and cleaning preparations.

2. Description of Related Art

It is known that nonionic surfactants have a very high detergent power, thus making them particularly suitable for use in low-temperature detergents or 60° C.-detergents. Unfortunately, in the standard spray-drying process generally used for manufacturing detergents, the nonionic surfactants cannot be used in an amount which significantly exceeds about 8 to 10% by weight, otherwise there is excessive pluming and waste of the surfactant in the offgases of the spray-drying towers, and the spray dried powder shows unsatisfactory flow properties. For this reason, processes have been developed in which the liquid nonionic surfactant is mixed with previously spray-dried powder or the surfactant is sprayed onto a carrier substance. Proposed carrier substances include spray-dried phosphates, borates or perborates, sodium aluminosilicates (zeolites), silica (Aerosil ®) and the like.

Unfortunately, these known carriers have certain disadvantages. Phosphates are often undesirable because of their eutrophicating property. Borates, perborates and zeolites typically have only a limited uptake capacity for liquids. Other adsorbents, such as kieselguhr and Aerosil ®, increase the amount of ash in the detergent and thus on the material to be cleaned, without providing a detergent effect.

U.S. Pat. Nos. 3,849,327; 3,886,098 and 4,269,722 describe free flowing detergent compositions made by spray drying an aqueous builder salt mixture, optionally containing an anionic surfactant or a small amount of a nonionic surfactant. Suitable builder salts include phosphates, carbonates, silicates and the like. The bulk of the nonionic surfactant then is applied to the spray dried adsorbent powder, e.g., by spraying the liquid surfactant onto the powder in a rotating drum. In Great Britain No. 2,095,274, a complex, low-silicate, adsorbent carrier is described prepared by spray drying an aqueous mixture of a zeolite, bentonite and known water soluble builders and optionally containing an anionic surfactant or a small amount of a polyacrylate.

DESCRIPTION OF THE INVENTION

The present invention relates to a granular adsorbent having a high uptake capacity for liquid ingredients of detergents and cleaning preparations, comprising (a) 60 to 80 wt. % of a cation-exchanging, synthetic aluminosilicate selected from the group consisting of zeolite A and zeolite X and mixtures thereof, said aluminosilicate containing water of hydration;

(b) 0.05 to 5 wt. % of sodium silicate having a $Na_2O$ to $SiO_2$ mole ratio within the range of about 1:2 to about 1:3.5;

(c) 3 to 15 wt. % of a homopolymer of a monomer selected from the group consisting of acrylic acid, methacrylic acid and maleic acid; or a copolymer made by polymerizing a mixture containing at least one of said monomers, and (d) 8 to 18 wt. % of water removable at a temperature of about 145° C.

The adsorbent may optionally include up to 5 wt. % of a nonionic surfactant containing polyglycol ether groups. The adsorbent has an average particle size within the range of about 0.2 to 1.2 mm, with less than 2 wt. % of the particles having a size of less than about 0.05 mm and with less than 5 wt. % of the particles having a size of greater than about 2 mm. The adsorbent has a bulk density in the range of about 400 to 700 g/l.

As used throughout the specification and claims, the term "liquid" broadly encompasses materials having a wide range of viscosities, not only including materials having a water-like viscosity but also highly viscous, paste-like materials. Also included are normally solid, low melting-point materials in their molten state, e.g., materials having a melting point below about 40° C.

The granular adsorbent of the present invention includes as its key ingredients a cation-exchanging aluminosilicate, sodium silicate and a particular water soluble polymeric component. It has been discovered, quite surprisingly, that this composition exhibits a high uptake capacity for liquid ingredients, and particularly nonionic surfactants, used in detergents and cleaning preparations.

The major constituent of the granular adsorbent is a cation-exchanging, synthetic aluminosilicate. In particular, crystalline aluminosilicates (zeolites) of the types A and X are preferred, with zeolite A being particularly preferred. These crystalline zeolites are well known in the art, e.g., see D. W. Breck, *Zeolite Molecular Sieves* (1974), John Wiley & Sons. It is also contemplated that mixtures of zeolite X with zeolite A could be used. When using a mixture of zeolites, however, it is preferred that the quantity of zeolite X in such mixtures be below about 30 wt. % and, more preferably, below about 20 wt. %. Suitable zeolites will contain water of hydration in an amount of about 4 wt. % to about 30% wt. % and higher. Normally, the zeolite will contain between about 5 to 15 wt. % bound water.

Preferably a synthetic sodium aluminosilicate is used in the granular adsorbent and sodium zeolite A (NaA) is particularly preferred. Suitable zeolites are characterized by their high exchange capacity or binding power for calcium. Typically, the calcium binding power of the zeolite, determined in accordance with the procedure outlined in U.S. Pat. No. 4,148,603 (col. 18, In. 28–41) which is hereby incorporated by reference, is at least about 50 mg CaO/g and preferably is between about 100 and 200 mg CaO/g.

The zeolite is preferably supplied in a finely divided state such that substantially all of the particles are smaller than about 30 microns, and preferably smaller than about 20 microns. Generally, at least 80 wt. % of the particles are smaller than about 10 microns in size. For example, a zeolite having at least 90 wt. % of the particles in the range of about 1 to 8 microns is particularly preferred. The zeolite comprises between about 60 to 80 wt. % of the granular adsorbent composition and preferably comprises between about 65 to 75 wt. %.

Another constituent of the granular adsorbent is sodium silicate. The sodium silicate used in the present invention has a mole ratio of $Na_2O$ to $SiO_2$ within the range of about 1:2 to about 1:3.5 and preferably from about 1:2.5 to 1:3.3. It also is contemplated to use a mixture of silicates of different alkali contents. For example, a mixture of a sodium silicate having a mole ratio of $Na_2O$ to $SiO_2$ of 1:2 with a sodium silicate having a mole ratio of $Na_2O$ to $SiO_2$ within the range of about 1:2.5 to 1:3.3 can be used.

For preparing the granular adsorbent, the silicate is preferably supplied as an aqueous solution. The amount of sodium silicate in the adsorbent composition comprises between about 0.05 and 5 wt. %, preferably between about 0.1 and 3 wt. % and, most preferably, between about 0.2 and 2 wt. %. Water soluble silicates of the type employed in the present invention increase the break resistance and minimize the dust formation during spray drying and admixing process. Higher contents of sodium silicate decrease the water solubility of the adsorbent in cold water and should be avoided.

The polymeric constituent of the granular adsorbent comprises a homopolymer and/or a copolymer of an unsaturated carboxylic acid monomer selected from the group consisting of acrylic acid, methacrylic acid and maleic acid (i.e., a polyacid). Procedures employed to prepare these polyacid polymeric materials are well known to those skilled in the art. Water soluble sodium or potassium salts of the polymeric constituent are preferred, with sodium salts being particularly preferred. Preferred polymeric constituents include the homopolymers: polyacrylic acid, polymethacrylic acid and polymaleic acid and their salts, as well as copolymers of acrylic acid with methacrylic acid and acrylic acid with maleic acid and their salts. Copolymers of acrylic acid, methacrylic acid or maleic acid with other vinyl monomers such as vinyl ethers, including vinyl methyl ether and vinyl ethyl ether; vinyl esters, including vinyl acetate and vinyl propionate; acrylamide; methacrylamide, ethylene, propylene and styrene also can be used as the polymeric constitutent. In order to ensure adequate water solubility for copolymers prepared using a combination of carboxylic acid monomers and non-acid, vinyl monomers, the fraction of the monomer reactants contributing no acid moiety to the ultimate polymer normally should be less that about 70 mole % and preferably less than about 60 mole % of the polymer.

Copolymers of acrylic acid or methacrylic acid with maleic acid and methods for their preparation are described in detail, for example, in EP 25 551-B1 and in Schaeffer et al. (1979) *Tenside,* 16: 82-89. These copolymers have proven to be particularly suitable in the present invention. Preferred copolymers of this class contain from about 40 to 90 wt. % of acrylic acid or methacrylic acid and from about 60 to 10 wt. % of maleic acid. Copolymers containing from about 45 to 85 wt. % of acrylic acid and from about 55 to 15 wt. % of maleic acid are particularly preferred.

The molecular weight of the polymeric constitutent (homopolymer of copolymer) is generally from about 1,000 to 150,000 and preferably is within the range of about 1,500 to 100,000. The granular adsorbent contains about 3 to 15 wt. % polymeric constituent and preferably contains about 4 to 12 wt. %. The abrasion resistance of the adsorbent particles increases with increasing amounts of polymeric constituent. Normally, adequate abrasion resistance is obtained when using the polymer constituent in an amount of about 4 to 5 wt. % of the adsorbent. Optimal abrasion properties are realized when the adsorbent contains from about 8 to 12 wt. % polymer.

In addition to the zeolite's water of hydration, which typically is strongly bound and requires a temperature of above about 145° C. for its removal, the granular adsorbent also includes some water which can be removed at a drying temperature of about 145° C. The moisture content removable at a temperature of about 145° C. comprises between about 8 and 18 wt. % of the adsorbent and preferably comprises between about 10 and 16 wt. %.

The granular adsorbent optionally contains a nonionic surfactant or surfactant mixture in an amount of up to about 5 wt. %. When included in the composition, the nonionic surfactant is preferably added in an amount of about 0.5 to 4 wt. % of the adsorbent. Suitable nonionic surfactants include in particular, ethoxylation products of linear or branched Oxo-type alcohols such as higher fatty alcohols, i.e., the reaction product of a fatty alcohol and ethylene oxide. The hydrophobic alkyl moiety of such reaction products should typically contain from about 8 to 22 carbon atoms and preferably about 12 to 18 carbon atoms, while the hydrophilic moiety contains from about 3 to 30 ethylene glycol ether groups (ethylene oxide groups) and preferably about 3 to 10 ethylene glycol ether groups per molecule. Other suitable nonionic surfactants include the ethoxylation products of vicinal diols; amines; thioalcohols and fatty acid amides which are analogous to the fatty alcohol ethoxylates in regard to both the number of carbon atoms in the hydrophobic or lipophilic moiety and to the number of glycol ether groups in the hydrophilic moiety. Alkyl phenol polyglycol ethers containing from about 5 to 12 carbon atoms in the hydrophobic alkyl moiety and from about 3 to 25 ethylene glycol ether groups and preferably about 3 to 10 ethylene glycol ether groups in the hydrophilic moiety may also be used. Finally, block polymers prepared by condensing ethylene oxide with a hydrophobic base formed by condensing propylene oxide with propylene glycol are also suitable. Block polymers of this type are commercially available from BASF Wyandotte under the trademark Pluronic®. Other suitable nonionic surfactants will be apparent to those skilled in the art.

The nonionic surfactants are preferably used as a dispersion stabilizer for aqueous zeolite dispersions used to prepare the granular adsorbent of the present invention. In some cases, the nonionic surfactant may be replaced in whole or in part with other dispersion stabilizers, for example of the type described in Canadian No. 1,062,984.

The present invention also relates to the process for producing the granular adsorbent. According to the process, an aqueous mixture of the key ingredients, i.e., an aluminosilicate, sodium silicate and polyacid polymer, and optionally including a nonionic surfactant, is spray dried. This aqueous mixture, typically should contain from about 50 to 65 wt. % water and preferably about 55 to 62 wt. % and should have a viscosity in the range of from about 5,000 to 20,000 mPa.s. Deionized or softened water is preferably used. The aqueous mixture typically will contain about 25 to 45 wt. % aluminosilicate, about 0.05 to 5 wt. % sodium silicate and about 1 to 9 wt. % polyacid polymer. This mixture, at a temperature in the range of from about 50° to 100° C., is sprayed through atomizing nozzles into a freefall column of known construction at spraying pressures generally in the range of from about 20 to 120 bar and preferably in the range of from about 30 to 80 bar. It is preferred to use two-component nozzles wherein compressed air is introduced into the tower along with the mixture to be sprayed.

The atomized droplets of the aqueous mixture are dried by direct contact with a hot gas generally having an inlet temperature of from about 150 to 280° C., preferably in the range of about 180° to 250° C. and more preferably in the range of about 190° to 230° C. Where so-called drying towers, into which the aqueous mixture is sprayed in the upper part through several high-pressure nozzles, are used, the inlet gas temperature is measured in the annular passage (i.e., immediately before entry into the lower part of the tower). The hot combustion products of a fuel oil or natural gas comprises a suitable drying gas. The atomized droplets fall through the hot gas either concurrent or preferably countercurrent to the gas flow. The flow rate of the aqueous mixture and the hot gas are controlled so that the moisture-laden gas has an exit temperature of from about 50° to 120° C. and preferably in the range from about 55° to 105° C., and the adsorbent particles are dried to a moisture content, removable at 145° C., within the range of about 8 to 18 wt. %.

The average particle size of the adsorbent recovered from the spray drying process should be within the range of about 0.2 to 1.2 mm. The quantity of particles smaller than about 0.05 mm should amount to no more than about 2 wt. % of the product and the quantity of particles larger than 2 mm should amount to no more than about 5 wt. %. Preferably at least 80 wt. % and, more preferably, at least 90 wt. % of the particles are within the range of about 0.1 to 1.2 mm in size. In this preferred embodiment, the quantity of particles between about 0.1 and 0.05 mm in size should amount to no more than about 10 wt. % and more desirably no more than about 5 wt. % of the product; while the quantity of particles between about 1.2 and 2 mm in size should likewise amount to no more than about 10 wt. % and more desirably, no more than about 5 wt. % of the product.

The bulk density of the spray dried adsorbent should be in the range of from about 400 to 700 g/l and preferably is in the range of from about 500 to 650 g/l.

The spray dried adsorbent essentially comprises rounded particles exhibiting very good flow behavior. Furthermore, it has been discovered that the adsorbent particles retain their good flow behavior even when they are subsequently impregnated with large amounts of liquid detergent ingredients, particularly nonionic surfactants, e.g., in an amount of up to about 40 wt. % of the adsorbent. Thus, the granular adsorbent of this invention is clearly superior to prior art carriers now used in detergents and cleaning preparations.

Instead of being produced by spray drying, the adsorbent can also be prepared, using known build-up granulation techniques to produce particles having the desired size, density and flow characteristics. For example an aluminosilicate in powder-form, an aqueous solution of sodium silicate and an aqueous solution of the polymeric carboxylic acid can be introduced in a known manner into a fluidized bed, followed by granulation and drying therein under conditions well recognized by those skilled in the art. As is known, build-up granulation may be carried out both continuously and batchwise.

It is preferred to impregnate the granular adsorbent with a liquid additive, such as a nonionic liquid surfactant. Generally, the adsorbent may be impregnated with the liquid by spraying the liquid onto the spray-dried adsorbent product. The liquid, and in particular a nonionic surfactant is applied in an amount of between about 2 to 45 wt. % based on the weight of the spray-dried adsorbent prior to treatment with the liquid. The temperature of the adsorbent when applying the liquid is not critical, and the liquid can be applied while the adsorbent is still hot, after it has cooled or after reheating. Providing the quantitative ratios of ingredients and the process conditions specified above are observed, the abrasion resistance and dimensional stability of the spray dried adsorbent particles are so high that even freshly prepared, but especially cooled and optionally reheated, aged granules may be sprayed with the liquid additive, mixed and transported under normal spray mixing conditions without forming any fines or relatively coarse agglomerates. For example, continuous blending and spraying of nonionic surfactant onto the adsorbent particles can be carried out using a tumbling or rotating drum of known design and operation.

The nonionic surfactant-loaded granular adsorbent or granular detergent recovered from the impregnation step typically contains (a) about 41 to 78 wt. % of the cation-exchanging, synthetic aluminosilicate;
(b) about 0.07 to 2.9 wt. % of the sodium silicate;
(c) about 2.1 to 14.7 wt. % of the polyacid polymer;
(d) about 5.5 to 17.6 wt. % of water, and
(e) about 2 to 35 wt. % of a nonionic surfactant.

Suitable liquid additives for use with the adsorbent of the present invention include nonionic surfactants useful in detergents and cleaning preparations, some of which have been identified above, as well as organic solvents useful for improving the detergent power of detergents and cleaning preparations. Temperature sensitive adjuvants (i.e., those which will not withstand the temperatures involved in spray drying), such as enzymes, biocides, perfumes, bleach activators, conditioners, optical brighteners and also anionic or cationic surfactants also may be impregnated on the adsorbent of the present invention by dissolving or dispersing them in an organic solvent or in the liquid nonionic surfactant. These known adjuvants can be used in amounts conventionally employed to accomplish their known functions. The adjuvants penetrate into the porous particles with the liquid additives and thus do not interfere with subsequent powder coating steps as hereafter described.

After the liquid additive has been applied, the adsorbent particles may optionally be powdered or surface-coated with fine powders. In this way, fluidity may be further improved and the powder density slightly increased. Suitable powdering agents, for example, comprise finely powdered zeolites, silica aerogel (Aerosil®), colorless or colored pigments, such as titanium dioxide, and other known powders, such as finely powdered sodium tripoly-phosphate, sodium sulfate, magnesium silicate and carboxymethyl cellulose. The powdering agents should have a particle size of from about 0.001 mm to at most about 0.1 mm and preferably have a particle size of less than about 0.05 mm. Such powdering agents may be used in an amount of from about 0.03 to 3 wt. % of the additive loaded adsorbent and preferably in an amount of from about 0.05 to 2 wt. %.

After the additives have been applied, the adsorbent particles may also be coated with a film of a water-soluble polymer. Suitable polymeric coating materials include water-soluble cellulose ethers, the polyacid polymers used in preparing the adsorbent composition, polyvinyl alcohol, polyvinyl pyrrolidone and polyacrylamide.

The following example is presented to illustrate further the present invention and is not intended to limit its scope which is defined by the attached claims.

EXAMPLE 1

The following constituents were mixed in a vessel equipped with a stirrer:

(i) 302.2 kg of an aqueous dispersion containing 45.0 wt. % of zeolite NaA, 1.5 wt. % of the reaction product of a $C_{12}$–$C_{18}$ fatty alcohol and 5 moles of ethylene oxide, 0.3 wt. % of NaOH and the balance water;

(ii) 45.0 kg of an aqueous solution containing 40 wt. % of the sodium salt of an acrylic acid-maleic acid copolymer;

(iii) 11.3 kg of an aqueous solution containing 34.5 wt. % of a sodium silicate having a $Na_2O$ to $SiO_2$ mole ratio of 1:3.3; and (iv) 41.5 kg of softened water.

The zeolite used had a distribution of particle sizes, including particles in the range of from about 1 to 8 microns. The fraction of particles larger than 8 microns in size comprised about 6 wt. % of the zeolite. There were no particles larger than 20 microns in size. The polycarboxylic acid copolymer of acrylic acid and maleic acid (sodium salt) had a molecular weight of 70,000 (Sokalan ®).

The slurry was heated to a temperature of about 82° C. and had a viscosity of about 9500 mPa.s. The hot slurry, at a pressure of 40 atms, was spray dried by direct contact with hot combustion gases. The slurry was sprayed into a tower of conventional design in a direction countercurrent to the flow of the hot gases (226° C. as measured in the annular passage). The exit temperature of the drying gas was 57° C. The granular adsorbent recovered from the spray-drying tower had the following composition:

(i) 74.5 wt. % zeolite NaA (corresponding to 68.4 wt. % of anhydrous substance);

(ii) 9.0 wt. % of the sodium salt of acrylic acid-maleic acid copolymer;

(iii) 2.0 wt. % sodium silicate ($Na_2O$:$SiO_2$=1:3);

(iv) 12.2 wt. % water removable at 145° C.; and (v) 2.3 wt. % ethoxylated fatty alcohol.

The density of the granular adsorbent was 550 g/l. The particle size distribution of the granular adsorbent as determined by sieve analysis, exhibited the following weight distribution:

| mm | over 1.6 | up to 0.8 | up to 0.4 | up to 0.2 | up to 0.1 | under 0.1 |
|---|---|---|---|---|---|---|
| % by weight | 0 | 1 | 37 | 53 | 9 | 0 |

The recovered granular adsorbent was cooled to about 20° C. and then was sprayed with a liquid (molten) mixture of nonionic surfactants. A spray mixing apparatus having a horizontally inclined cylindrical drum equipped with mixing elements and spray nozzles (LODIGE mixer) was used. The surfactant mixture included 30.1 wt. % tallow alcohol containing 5 EO groups (ethylene oxide groups), 34.6 wt. % of tallow alcohol containing 14 EO groups and 35.3 wt. % of an oleyl alcohol-cetyl alcohol mixture (iodine number 53) containing 7 EO groups. The surfactant melt having a temperature of about 50° C. was sprayed onto the granular adsorbent.

For a commercially relevant comparison, loose sodium tripolyphosphate, specifically developed as a carrier for nonionic surfactants (Thermphos ®); a high capacity commercial adsorbent prepared by spray-drying a sodium carbonate-sodium bicarbonate mixture (Snowlite ®) and a spray-dried zeolite NaA powder having the same particle size distribution as the zeolite used to prepare the adsorbent of the present invention were similarly sprayed with the liquid mixture of nonionic surfactants.

In order to compare their flow behavior, 1 liter of the various powders was introduced into a funnel initially closed at its outlet opening, and the time required for the powder to flow through the funnel was measured. The funnel had the following dimensions:

| | |
|---|---|
| diameter of the upper opening | 150 mm |
| diameter of the lower opening | 10 mm |
| height of the conical funnel section | 230 mm |
| height of the lower cylinderical section | 20 mm |
| angle of inclination of the conical section (towards the horizontal) | 73° |

Dry sea sand having the following particle size distribution was used as a comparison substance:

| mm | over 1.5 | up to 0.8 | up to 0.4 | up to 0.2 | up to 0.1 |
|---|---|---|---|---|---|
| % by weight | 0.2 | 11.9 | 54.7 | 30.1 | 3.1 |

The elapsed time for the dry sand to flow through the funnel was used as a standard, and the relative fluidity of the various powders was calculated using the following equation:

$$\text{Relative fluidity} = \frac{\text{Elapsed time for powder sample}}{\text{Elapsed time for sand}} \times 100\%$$

Thus, a relative fluidity of 100% means the adsorbent carrier powder has the same flow characteristic as dry sand; while a relative fluidity of zero means the carrier powder did not flow through the funnel. Table I summarizes the relative fluidity results for the various carrier powders at various loadings of nonionic surfactant. The densities of the powders are also included. Flow data was gathered shortly after the carrier powders were loaded with surfactant (15 min) and after a period of aging (24 hours).

TABLE I

| Adsorbent | Surfactant wt. loading | Powder density g/l 15 mins | Powder density g/l 24 hours | Relative Fluidity % 15 mins | Relative Fluidity % 24 hours |
|---|---|---|---|---|---|
| This | 25 | 611 | 580 | 80 | 72 |
| Example | 35 | 715 | 685 | 100 | 71 |
| | 40 | 721 | 719 | 0 | 63 |
| Thermphos ® | 30 | 630 | 491 | 0 | 0 |
| Snowlite ® | 25 | 595 | 575 | 85 | 82 |
| | 35 | 656 | 640 | 81 | 77 |
| | 40 | 585 | 553 | 0 | 0 |
| Zeolite | 25 | 780 | 776 | 0 | 0 |

As the data demonstrates, aging allows the nonionic surfactant to diffuse into the carrier particles, so that flow behavior is best determined 24 hours after preparing the surfactant loaded powder. As demonstrated by the relative fluidity results, none of the comparison products are capable of maintaining adequate fluidity while taking up 40 wt % of the nonionic surfactant. After an aging period however, the absorbent of the present invention showed very good flow behavior, comparable with that of a conventional spray-dried detergent. It is important to note that the actual amount of nonionic surfactant loaded on the carrier powder of the present invention is actually 2.3 wt. % higher than the loading on the comparison carrier powder because of the nonionic surfactant used in the preparation of the adsorbent of this invention. The superiority of the granular adsorbents of the present invention is clearly evident.

Although certain embodiments of the invention have been described in detail, it will be appreciated that other embodiments are contemplated, along with modification of the disclosed features, as being within the scope of the invention, which is defined in the appended claims.

EXAMPLE 2

As described in example 1 a slurry was made and sprayed into the drying tower at a pressure of 40 atms. The water content of the slurry was 35 weight %, the temperature was 83.5° C. and the viscosity at this temperature was 9200 mPa.s. The drying gas had an entrance temperature of 230° C. (as measured in the annular passage) and an exit temperature of 58° C. The spray dried granular adsorbent had the following composition (pbw.=parts by weight):

| | |
|---|---|
| (i) | 46.7 pbw. zeolite NaA (related to anhydrous substance); |
| (ii) | 5.0 pbw. of the sodium salt of acrylic acid/maleic acid copolymer (average molecular weight 70000, acrylic acid content 70 weight %, maleic acid content 30 weight %); |
| (iii) | 0.14 pbw. sodium silicate ($Na_2O$: $SiO_2$ = 1:3.3 |
| (iv) | 1.56 pbw. ethoxylated tallow fatty alcohol (5 EO groups); |
| (v) | 0.6 pbw. sodium sulfate; |
| (vi) | 13.6 pbw. water (9.8 pbw. removable at 145° C.) |
| sum | 67.5 pbw. |

The zeolite used had the particle size distribution as shown in example 1. The ethoxylated tallow alcohol consisted of 30 weight % of cetyl alcohol and 70 weight % of stearyl alcohol.

The density of the spray dried granular adsorbent was 540 g/l. The particle size determind by sieve analysis exhibited the following weight distribution:

| mm | over 1.6 | up to 0.8 | up to 0.4 | up to 0.2 | up to 0.1 | under 0.1 |
|---|---|---|---|---|---|---|
| % by weight | 0 | 2 | 40 | 50 | 8 | 0 |

67.5 pbw. of the granular adsorbent were impregnated with 32.5 pbw. of a mixture of nonionic surfactants in a mixing apparatus as described in example 1. The adsorbent had a temperature of 25° C. and the molten mixture of the nonionic surfactant had a temperature of 50° C. The surfactant mixture consisted of 4.1 pbw. tallow alcohol containing 5 EO groups, 20 pbw. of an lauryl alcohol-myristyl alcohol mixture (mixing proportion 2:1) containing 5 EO groups, and 8.3 pbw. of an oleyl alcohol-cetyl alcohol mixture (mixture proportion 2:1) containing 7 EO groups. The whole content of nonionic surfactant, based on the impregnated granules was 34 weight %.

After cooling the granules they were powdered with 3 weight % of the zeolite in a fluidized bed mixer. The density of the resulting granules (15 minutes after loading) was 740 g/l, and the relative fluidity (determined by the method shown in example 1) was 100% compared to dry sand. 24 hours later the density was 710 and the relative fluidity was 87%.

EXAMPLE 3

Example 2 was repeated but the acrylic acid-maleic acid copolymer was substituted by the sodium salt of a homopolymeric acrylic acid (molecular weight of the polymeric acid=75,000). The resulting granules had a density of 520 g/l and the following particle size:

| mm | over 1.6 | up to 0.8 | up to 0.4 | up to 0.2 | up to 0.1 | under 0.1 |
|---|---|---|---|---|---|---|
| % by weight | 0 | 3 | 34 | 49 | 13 | 0 |

After loading with the said mixture of nonionic surfactants and powdering with 4% finely devided zeolite NaA the density of the granules was 700, and the relative fluidity was 92% compared to dry sand. 24 hours after processing the density was 670 and the fluidity 82%.

We claim:

1. A spray-dried granular adsorbent having a high uptake capacity for liquid ingredients of detergents and cleaning preparations consisting of:

(a) 60 to 80 wt. % of a cation-exchanging, synthetic aluminosilicate selected from the group consisting of zeolite A, zeolite X, and mixtures thereof, said aluminosilicate containing water of hydration:

(b) 0.05 to 3 wt. % of sodium silicate having a $Na_2O$ to $SiO_2$ mole ratio within the range of about 1:2 to about 1:3:5;

(c) 3 to 15 wt. % of a polymeric constituent consisting of a homopolymer of a monomer selected from the group consisting of acrylic acid, methacrylic acid and maleic acid; or a copolymer made by polymerizing a mixture containing at least one of said monomers, said polymeric constituent having a molecular weight of from about 1,000 to about 150,000, (d) 8 to 18 wt. % of water removable at a temperature of about 145° C., and, (e) up to about 5 wt. % of a nonionic surfactant, said adsorbent having particles with an average particle size within the range of about 0.2 to 1.2 mm and having a bulk density in the range of about 400 to 700 g/l.

2. The granular adsorbent of claim 1 wherein less than 2 wt. % of said particles have a particle size of less than about 0.05 mm and less than 5 wt. % of said particles have a particle size of more than 2 mm.

3. The granular adsorbent of claim 1 wherein said nonionic surfactant has polyglycol ether groups.

4. The granular adsorbent of claim 1 having about 65 to 75 wt. % of said aluminosilicate, about 0.1 to 3 wt. % of said sodium silicate, about 4 to 12 wt. % of said homopolymer or copolymer, about 10 to 16 wt. % of said water, and about 0.5 to 4 wt. % of said nonionic surfactant.

5. The granular adsorbent of claim 2 wherein at least 80 wt. % of said particles have a particle size within the range of about 0.1 to 1.2 mm.

6. The granular adsorbent of claim 5 wherein all of said particles are smaller than about 2 mm and at least 90% of said particles have a particle size within the range of about 0.1 to 1.2 mm.

7. The granular adsorbent of claim 1 having a bulk density of from about 500 to 650 g/l.

8. The granular adsorbent of claim 1 having about 0.2 to 2 wt. % by weight of said sodium silicate.

9. The granular adsorbent of claim 1 wherein said homopolymer or copolymer is selected from the group consisting of (i) polyacrylic acid, (ii) a copolymer of acrylic acid and maleic acid, and (iii) the sodium and potassium salts of (i) and (ii).

10. The granular adsorbent of claim 1 having impregnated therein from about 2 to 45 wt. %, based on the granular adsorbent, of a nonionic surfactant.

11. The granular adsorbent of claim 10 wherein said adsorbent has a coating of a finely powdered material.

12. A granular detergent consisting of;

(a) about 41 to 78 wt. % of a cation exchanging, synthetic aluminosilicate selected from the group consisting of zeolite A, zeolite X and mixtures thereof, said aluminosilicate containing water of hydration (b) about 0.07 to 2.8 wt. % of sodium silicate having a $Na_2O$ to $SiO_2$ mole ratio in the range of about 1:2 to about 1:3.5.

(c) about 2.1 to 14.7 wt. % of a homopolymer of a monomer selected from the group consisting of acrylic acid, methacrylic acid and maleic acid, or a copolymer made by polymerizing a mixture containing at least one of said monomers;

(d) about 5.5 to 17.6 wt. % of water removable at a temperature of about 145° C., and (e) about 2 to 35 wt. % of a nonionic surfactant.

13. The granular detergent of claim 12 wherein said nonionic surfactant is an ethoxylation product of a compound selected from the group consisting of fatty alcohols; vicinal diols, amines, thioalcohols, and fatty acid amides.

14. The granular detergent of claim 12 wherein said nonionic surfactant is an alkyl phenol polyglycol ether.

15. The granular detergent of claim 12 wherein said nonionic surfactant is a block polymer prepared by condensing ethylene oxide with a condensation product of propylene glycol and propylene oxide.

16. A process for producing a granular adsorbent as in claim 1 having a high uptake capacity, for liquid ingredients of detergents and cleaning preparations consisting of (a) forming an aqueous mixture of (i) a cation-exchanging synthetic aluminosilicate selected from the group consisting of zeolite A, zeolite X and mixtures thereof, said aluminosilicate containing water of hydration; (ii) sodium silicate having a $Na_2O$ to $SiO_2$ mole ratio within the range of about 1:2 to about 1:3.5; and (iii) a homopolymer of a monomer selected from the group consisting of acrylic acid, methacrylic acid and maleic acid; or a copolymer made by polymerizing a mixture containing at least one of said monomers; and 50 to 65 wt. % water, and (b) spray drying said aqueous mixture.

17. The process of claim 16 wherein said spray drying consisting of (a) pumping said aqueous mixture at a pressure within the range of about 20 to 120 bar and at a temperature within the range of about 50° to 100° C. through a nozzle into a free-fall column to form atomized droplets of said aqueous mixture;

(b) contacting said atomized droplets with a drying gas having a temperature within the range of about 150° to 280° C.;

(c) separately recovering a moisture-laden gas having a temperature within the range of about 50° to 120° C. and an adsorbent powder having a moisture content removable at 145° C. of about 8 to 18 wt. % from said column.

* * * * *